US009206814B2

(12) United States Patent
Satishchandra et al.

(10) Patent No.: US 9,206,814 B2
(45) Date of Patent: Dec. 8, 2015

(54) ENERGY SAVING PUMP WITH MULTIPLE IMPELLERS

(75) Inventors: Madhusudan Rajam Satishchandra, Bangalore (IN); Ashok Manohar Pujar, Bangalore (IN); Karunakara Talawara, Bangalore (IN); Sabari Giridharan Rajendran, Bangalore (IN)

(73) Assignee: HCL Technologies LTD., Chennai (IN)

( * ) Notice: Subject to any disclaimer, the term of this patent is extended or adjusted under 35 U.S.C. 154(b) by 545 days.

(21) Appl. No.: 13/521,839

(22) PCT Filed: Jun. 15, 2010

(86) PCT No.: PCT/IN2010/000403

§ 371 (c)(1),
(2), (4) Date: Jul. 12, 2012

(87) PCT Pub. No.: WO2011/114345

PCT Pub. Date: Sep. 22, 2011

(65) Prior Publication Data

US 2013/0011237 A1 Jan. 10, 2013

(30) Foreign Application Priority Data

Mar. 19, 2010 (IN) ..... 737/CHE/2010

(51) Int. Cl.

| | |
|---|---|
| ***F04D 15/00*** | (2006.01) |
| ***F04D 29/20*** | (2006.01) |
| ***F04D 13/02*** | (2006.01) |
| ***F04D 15/02*** | (2006.01) |

(52) U.S. Cl.

CPC ..... *F04D 29/20* (2013.01); *F04D 13/02* (2013.01); *F04D 15/0027* (2013.01); *F04D 15/029* (2013.01)

(58) Field of Classification Search

CPC ..... F04D 15/0027; F04D 13/021; F04D 15/0072; F04D 1/10; F04D 1/06; F04D 13/14; F04D 29/20; F04D 15/029; F04D 13/02

See application file for complete search history.

(56) References Cited

U.S. PATENT DOCUMENTS

| | | | | |
|---|---|---|---|---|
| 3,188,887 | A | 6/1965 | Gabriel | |
| 6,179,553 | B1 * | 1/2001 | Liegat | 415/61 |
| 6,296,459 | B1 | 10/2001 | Saputo et al. | |
| 2006/0115379 | A1 | 6/2006 | Bach et al. | |
| 2008/0115527 | A1 | 5/2008 | Doty et al. | |

OTHER PUBLICATIONS

International Search Report for International Patent Application No. PCT/IN2010/000403 dated May 5, 2011.

* cited by examiner

*Primary Examiner* — Richard Edgar
(74) *Attorney, Agent, or Firm* — Knobbe Martens Olson & Bear LLp

(57) ABSTRACT

A centrifugal pump incorporates multiple impellers which are driven by a shaft at constant speed. To engage an impeller, a ball end rod is operated, which interacts with an integral structure which comprises a disc, connector or a support collar, and face gear as linking means. The integral structure is further coupled with the impeller. During engagement, a linking means which is mounted on the impeller and also on the integral structure get coupled together resulting in engaging the impeller for rotation. The impellers can be engaged and disengaged according to the flow requirements thereby saving the energy.

14 Claims, 2 Drawing Sheets

115
64
117
112
95

83
115
88
64
95
112
86

63
128
130
14
12
13
17
63
131
127
129
64
b
113
115
93
11

54
88
64
117
93
112

ENERGY SAVING PUMP WITH MULTIPLE IMPELLERS

CROSS REFERENCE TO RELATED APPLICATIONS

This application claims the benefit and priority to and is a U.S. National Phase Application of PCT International Application Number PCT/IN2010/000403, filed on Jun. 15, 2010, designating the United States of America and published in the English language, which is an International Application of and claims the benefit of priority to Indian Patent Application No. 737/CHE/2010, filed on Mar. 19, 2010. The disclosures of the above-referenced applications are hereby expressly incorporated by reference in their entireties.

TECHNICAL FIELD

The subject matter described herein generally relates to integrated centrifugal pump and particularly relates to integrated centrifugal pump having multiple disengageable impellers.

BACKGROUND

Desirable performance of centrifugal pumps is required not only at high flow but also at low flow. When a pump is required to operate for reduced pressure head, it ends up consuming more power as the excess pressure is dissipated in the valves by closing the valves by nearly 50% or more by increasing System resistance. To avoid energy wastage during the low flow, the pumping assemblies known in the art utilize a variable frequency drive with a motor, a drive or a pulley drive to control the flow by varying the speed of pump shaft rotation. However, employment of the pulley drive requires stopping the pump for the change of speed. Further, the use of a gear box or the variable frequency drive unit increases the procurement costs of the pumping assembly.

In order to avoid using gear box, frequency drive or pulley unit, the prior art technologies have used pumps with multiple impellers housed in the multiple chambers where one of the chamber is closed for flow. Nevertheless, the impeller in the closed chamber continues to rotate and heats the fluid thereby wasting energy.

Other solutions how to avoid the energy wastage of the pumping assemblies were to furnish the pumps with disengage-able impellers in order to prevent rotation of the impeller in the closed chamber so that the heating of the medium is eliminated. A friction clutch is provided to engage and disengage one of the impellers according to the flow requirements. However, the employment of the friction clutch is rather expensive as the clutch manufacturing and maintenance is costly. Furthermore, additional costs incur due to employment of high capacity bearings or additional bearings as the higher axial force is required to keep the clutch faces together for higher transmission. Another disadvantage of pump assemblies using the friction clutch is that the clutch needs to be immersed in oil so its application is restricted to pumping oil and clear fluids.

Employment of the clutch for the engagement and disengagement of impellers during low flow results in desired energy saving. But the energy saving is less due to the slip loss in the clutch. Pumps with clutch utilization known in art can operate in parallel or in serial relationship. For pumps operating in parallel, one high flow and one low flow impellers are used which results in unstable pressure output due to mismatch of the pressure versus flow curve of the dissimilar impellers. On the other hand, in the pumps in serial relationship, the resultant flow corresponds to the smaller flow of the one of equal or unequal size impeller. Hence, the large flow capacity (in case of unequal impellers) of the other impeller is not utilized.

Thus, there is a need for a pump with multiple engage-able impellers, which overcomes the above mentioned drawbacks and provides energy-saving, low maintenance-cost pump assembly with stable performance at low flow.

SUMMARY OF INVENTION

An object of the present subject matter is to provide a centrifugal pump assembly having multiple engage-able impellers which can be engaged and disengaged according to the flow requirements.

Also, another object of the present subject matter is to provide a centrifugal pump assembly having face gears to aide in engaging and disengaging disengage-able impeller(s).

Another object of the present subject matter is to provide a centrifugal pump assembly having an operating means i.e. ball rod assembly to engage and disengage the multiple impellers while shaft is rotating at constant speed.

Yet another object of the present subject matter is to provide a centrifugal pump assembly having impellers, which can be operated either in parallel or in series flow relationship with stable pressure output.

Still another object of the present subject matter is to provide a centrifugal pump assembly in which power at the partial low flow can be saved by 30 to 50%.

Accordingly, the subject matter described herein provides a centrifugal pump assembly, which is suitable for pumping fluids.

To achieve said objectives of the present disclosure provides pump with multiple impellers comprising: a casing, a plurality of impellers disposed in the casing, a driving means to drive the plurality of impellers, an engaging means comprising: an operating means, an integral structure interacting with the operating means on one end and at least one impeller, said at least one impeller gets engaged with the driving means for rotation by operating the integral structure by operating means.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figures 1A, 1B, 1C, 1D:
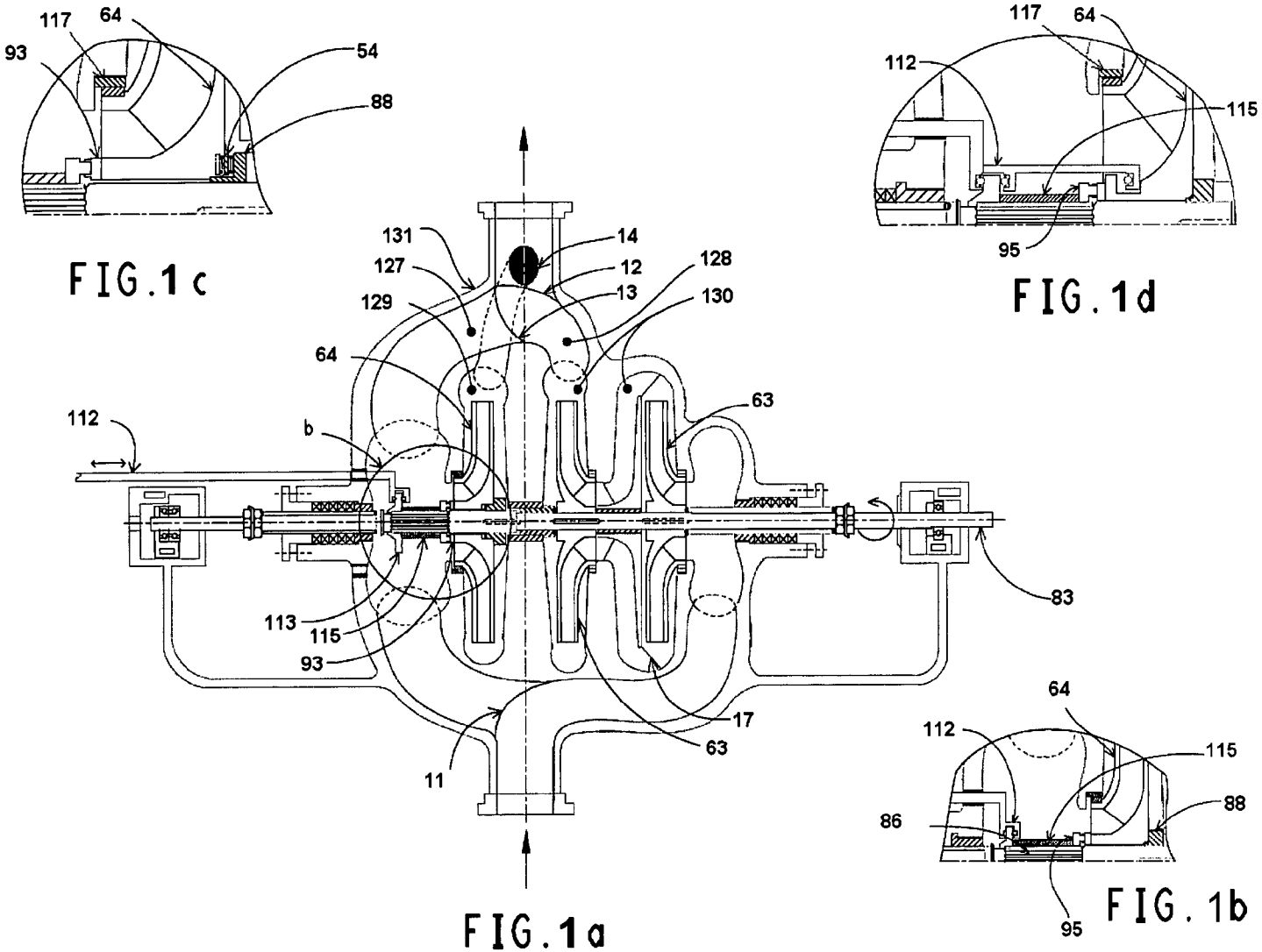
FIGS. 1*a*, 1*b*, 1*c*, and 1*d*, illustrate different aspects of a centrifugal pump with front geared impeller.

The centrifugal pump as shown in FIG. 1 comprises plurality of impellers 63, 64 which are housed within two or more chambers of the casing 131. The casing 131 has at least two chambers i.e. left chamber 129 and right chamber 130 separated by a wall in the middle, and a driving means driving the impellers 63, 64. Said driving means comprises a shaft 83 that runs through the chambers 129, 130 of the casing 131. Chambers 129, 130 of the casing 131 accommodate at least one non-disengage-able impeller 63 and at least one engage-able impeller 64 each respectively. The chambers 129, 130 are grouped into two or more compartments i.e. a left compartment 127 and a right compartment 128 as shown in FIG. 1. The compartments 127, 128 can be connected in series to generate higher head or in parallel to generate higher flow by using selection valves 11, 12, 13, 14. The valves 11, 12, 13, 14 are to serve the purpose of attaining lower output when required by diverting or closing the path of the flow and not for throttling the flow. The arrangements of the impellers 63, 64 can be either that non-disengage-able impeller 63 is first in the flow path whereas disengage-able impeller 64 operates as second in the flow path or vice versa.

If both flow and pressure are required to be low, the disengage-able impeller 64 in one compartment 127 is disengaged from rotation. The compartment 127 housing the disengage-able impeller 64 is blocked for flow and detached for power saving during low flow. Moreover, the chamber 129 is closed for flow by closing the appropriate valve(s) (11, 12, 13, 14) at least at the inlet or outlet or both. All impellers 63, 64 when engaged, rotate at the same speed. However, the disengage-able impeller 64 when disengaged remains idle, thereby saving energy. The impellers 63, 64 can be of equal or unequal size in order to generate low head and/or high head.

In the first embodiment of the present invention a first linking means as face gear 93 is mounted on the flow side of the disengage-able impeller 64 whereas a second linking means, face gear 95 is permanently fixed to a support collar 115. Here, the linking means comprises a two-part face gear 93, 95 where face gear 93 is mounted at the front side of the impeller 64. Such arrangement is referred to as a front geared impeller.

The front geared impeller is engaged for rotation by an engagement means. The engagement means comprises an integral structure formed by a disc 113, support collar 115 and the face gear 95 fixed thereon. The integral structure is mounted on a splined sleeve 86 as shown in FIG. 1*b*. The integral structure is pushed or retraced by an operating means comprising a ball end rod 112. During engagement of the disengage-able impeller 64, the ball end rod pushes the whole integral structure against the face gear 93 fixed on the flow side of the impeller 64 as shown in FIG. 1*a, c* so that the both parts of linking means i.e. first part of the face gear 93 and second part of the face gear 95 get coupled together. The disengage-able impeller 64 slides slightly into a centering collar 88 and gets centered for rotation. The centering collar 88 has a spring 54 which is compressed during the engagement and rotation while in order to disengage the disengage-able impeller 64, the ball end rod 112 is retracted and hence the impeller 64 is pushed out by the spring 54 placed in the centering collar 88. While disengaged, the disengage-able impeller 64 rests on the casing wearing ring 117.

In another embodiment of the front geared impeller, the ball end rod 112 comprises an extended portion as shown in FIG. 1*d*. The extended portion of the ball end rod 112 fits in the slot provided in the disengage-able impeller 64 in order to operate said impeller 64. Hence, no spring is required in the centering collar 88 as the impeller 64 is being pulled back from the centering collar 88 directly by the extended portion of the ball end rod 112.

Figures 2A, 2B:
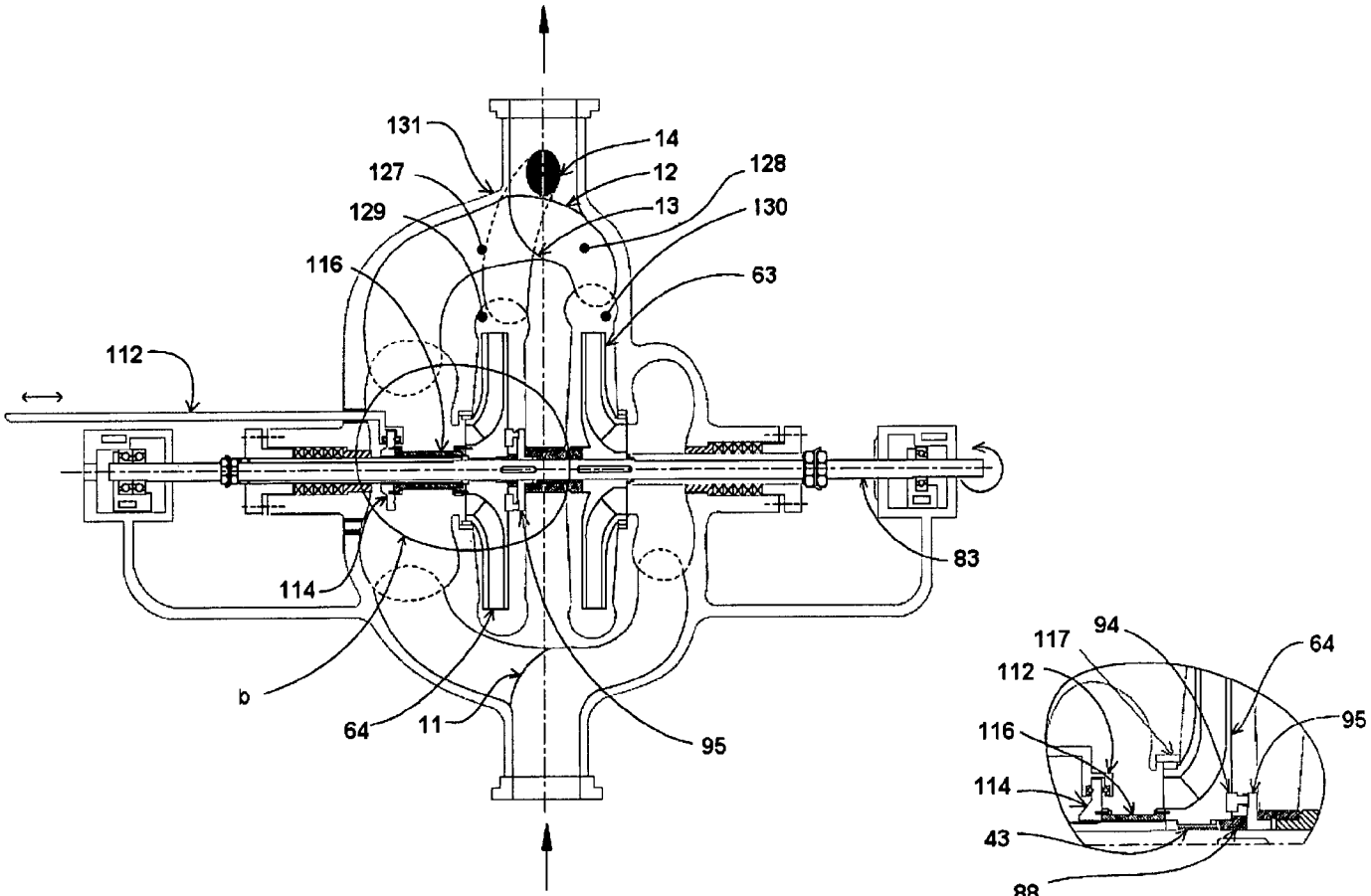
FIGS. 2*a* and 2*b* illustrate different aspects of a centrifugal pump with rear geared impeller.

FIG. 2 illustrates another embodiment of the present invention, in which the face gear 94 is attached to the non-flow side of the disengage-able impeller 64. This arrangement is referred to as back geared impeller, wherein the linking means comprise a two-part face gear 94, 96.

The disengage-able impeller 64 along with the face gear 94, connector 116 and disc 114 forms an integral structure. Unlike the front geared impeller arrangement, the disc 114 and connector 116 has good clearance with the driving means such that there will be no transmission of motion from the driving means unless pushed by ball end rod. Said integral structure is pushed by the ball end rod 112 forcing the disengage-able impeller 64 to slide onto the centering collar 88. As a result of that first part of the face gear 94 mounted on the disengage-able impeller 64 gets coupled with second part of the face gear 95. Said second part of the face gear 95 is mounted on the driving means 83 and a collar 88 is mounted for centering the impeller 64. Thereby the disengage-able impeller 64 gets engaged for rotation. A bearing 43 is disposed between shaft 83 and the disengage-able impeller 64. To disengage the disengage-able impeller 64, the ball end rod 112 is retracted pulling back whole integral structure. Also, during disengaged mode impeller 64 rests on the casing wearing ring 117.

Different embodiment of the present invention can include multiple disengage-able impellers housed in the multiple chambers which can be built in various shaft and casing arrangements such as horizontal and vertical shaft pumps with axial split casing and volute casing, end suction pump, multistage horizontal shaft pump with ring section casing having diffuser vanes at the exit. The pump can also be built in the vertical shaft type with multiple disengaging impellers in multi chambers with both volute and diffuser casing.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

We claim:

1. A pump comprising:

a casing enclosing a plurality of impellers;

a driving means to drive the plurality of impellers;

the plurality of impellers comprising at least one non-disengageable impeller and at least one disengageable impeller, wherein the at least one disengageable impeller is capable of engaging or disengaging with the driving means according to the flow requirement of the pump;

an engaging means comprising: an operating means; and an integral structure being operated by the operating means and interacting with the at least one disengage-able impeller; and at least one pair of linking means for engaging the at least one disengageable impeller with the driving means; wherein said at least one disengageable impeller becomes engaged with the driving means by operating the integral structure by operating means.

2. The pump as claimed in claim 1, wherein said linking means comprises face gears.

3. The pump as claimed in claim 1, wherein the integral structure comprises a disc, which is directly operated by the operating means; an inside splined supported collar with the attached second linking means, which gets coupled with the first linking means mounted on at least one impeller.

4. The pump as claimed in claim 1, wherein the integral structure comprises:

a disc, which has clearance with the driving means, wherein said disc is directly operated by the operating means; and a connector, which is joined with at least one impeller with the attached first linking means, wherein said first linking means is coupled with a second linking means mounted on the driving means.

5. The pump as claimed in claim 1, wherein the operating means comprises a ball end rod.

6. The pump as claimed in claim 5, wherein the ball end rod comprises an elongated extended portion connecting the ball end rod with at least one impeller and disc of the integral structure.

7. The pump as claimed in claim 6, wherein the extended portion of the ball end rod is accommodated in a slot provided in at least one impeller.

8. The pump as claimed in claim 1, wherein the driving means comprises a shaft.

9. The pump as claimed in claim 1, wherein the operating means is operated manually or automatically.

10. The pump as claimed in claim 1, wherein at least one constantly rotating impeller is arranged as first in the flow path and at least one detachable impeller is arranged as second in the flow path and vice versa.

11. The pump as claimed in claim 1, wherein the impellers have an equal size and/or an unequal size in order to generate low head and/or high head.

12. The pump as claimed in claim 1, wherein the plurality of impellers operate either in parallel or series relationship to generate higher flow or pressure respectively.

13. The pump as claimed in claim 1, wherein the plurality of impellers are arranged either back to back with opposed suction or in series with suction from the same direction.

14. The pump as claimed in claim 1, wherein the shaft and the casing are arranged in any of the following configurations namely a horizontal axial split, a volute casing a multistage ring section with diffuser casing, an end suction pump or a vertical shaft type with the plurality of impellers housed in the plurality of chambers with both volute and diffuser casings.

* * * * *